US008602455B2

(12) United States Patent
Ligouri et al.

(10) Patent No.: US 8,602,455 B2
(45) Date of Patent: Dec. 10, 2013

(54) FLEXIBLE SKI TIP CONNECTING DEVICE

(76) Inventors: Lisa Ligouri, Poway, CA (US); Daniel Ligouri, Coronado, CA (US)

( * ) Notice: Subject to any disclaimer, the term of this patent is extended or adjusted under 35 U.S.C. 154(b) by 687 days.

(21) Appl. No.: 12/590,740

(22) Filed: Nov. 12, 2009

(65) Prior Publication Data

US 2011/0109072 A1 May 12, 2011

(51) Int. Cl.
*A63C 11/00* (2006.01)

(52) U.S. Cl.
USPC ..... 280/818; 280/817

(58) Field of Classification Search
USPC ..... 280/14.28, 818, 817, 809, 816, 801.1; 434/253
See application file for complete search history.

(56) References Cited

U.S. PATENT DOCUMENTS

| | | | | | |
|---|---|---|---|---|---|
| 2,593,974 | A * | 4/1952 | Brown | 280/14.28 |
| 3,264,663 | A | 8/1966 | Owens | |
| 3,357,714 | A * | 12/1967 | Kuehn | 280/818 |
| 3,703,299 | A | 11/1972 | Kutchma | |
| 3,862,764 | A * | 1/1975 | Hartz | 280/818 |
| 3,992,022 | A * | 11/1976 | Albers | 280/818 |
| 4,275,904 | A * | 6/1981 | Pedersen | 280/818 |
| 4,505,681 | A * | 3/1985 | Jones | 434/253 |
| 4,828,288 | A | 5/1989 | Humbert | |
| 4,936,603 | A | 6/1990 | Reynaud | |
| 5,074,795 | A * | 12/1991 | Clark | 280/801.1 |
| 5,531,480 | A | 7/1996 | Foertsch | |
| 7,052,044 | B1 * | 5/2006 | Streeter | 280/818 |
| 2009/0039635 | A1 | 2/2009 | Bailey | |

* cited by examiner

*Primary Examiner* — Hau Phan

(74) *Attorney, Agent, or Firm* — William Propp, Esq.

(57) ABSTRACT

A ski tip connecting device has a flexible connector connecting a first lever clamp to a second lever clamp. The first lever clamp holds the ski tip of a first ski. The second lever clamp holds the ski tip of a second ski. The flexible connector maintains a short distance between the ski tips allowing the ski tails to separate to a wider distance with the skis forming a snowplow position.

2 Claims, 8 Drawing Sheets

FLEXIBLE SKI TIP CONNECTING DEVICE

BACKGROUND OF THE INVENTION

This invention relates generally to a device for connecting the ski tips on a pair of snow skis for beginning skiers, older skiers, or skiers without well developed leg strength and control, and, more particularly, this invention is directed to a flexible ski tip connector having a pair of lever clamps connected by a flexible connector which force the skis into a snowplow position and which are easily attachable and removable from the skis.

Beginning snow skiers often have difficulty controlling their skis to keep the tips of their skis together. Without adequate control of the skis when they encounter snow, control that comes from experience, the right and left ski tends to go in different directions for the skier.

Typically, the skis open up to the spread-out position. The beginning skier lacks the leg strength to pull the skis together. Falls, splits and spills may result. The skis may also invariably separate, cross or run one ahead of the other, again causing the beginner to fall.

Although ski teaching styles vary from instructor to instructor and from one ski slope to another, most skiers will begin by mastering the snowplow, or wedge. The beginning skier is taught to "snowplow" to permit the student to acquire a high degree of control of their skis early in their instruction.

In the snowplow position, the skier must keep the tips of his skis together while spreading out the tails of the skis to form an approximate V position. The tip of the V formed by the tip of the skis points down the slope. The skier then bends his or her knees forward and slightly inward causing the skis to ride on their inside edges (edging), thus digging into the snow on the slope.

The angle of the skis is used to control the skier's speed, even to bring the skier to a stop. A wider angle with the tails of the skis relatively further apart than the tips will traverse the slope much more slowly than a narrower angle.

By varying the amount of edging, the skier can control the speed and control the turns down the slope. When beginners have learned the snowplow position and how to control their speed down the slope, they can then process on to more advanced positions and types of skiing.

Beginning snow skiers often have difficulty creating a wedge shape with their skis. They have difficulty creating the shape and they also have a hard time holding the shape once they start moving down the slope.

The beginning skier's attention is often devoted primarily to the problem of staying upright, rather than to the refinement of aligning the skis in snowplow.

The above snowplow movements require an amount of leg strength and stamina. A beginning skier, particularly a child, does not initially possess the necessary strength and stamina to successfully ski. A child skier may not have the physical development yet to co-ordinate the opposing motions of skiing. This applies not just to beginning skiers, but also older skiers, or skiers without well developed leg strength and control.

It is the principal object of this invention to provide a flexible ski tip connector which will automatically keep the ski tips together to make and maintain the snowplow position and further provide a means for the instructor to control the speed of a skier down a slope.

Over the years, several inventions have been proposed to keep ski tips together to force the skier into the snowplow position. However, each of these inventions has the same problems over and over again.

For a ski tip connector to be effective to form the perfect wedge, it must be compact, easy to secure to the skis, and easy to use in cold weather by a skier wearing mittens or gloves. Moreover, it must allow the skis to be easily connected or disconnected from each other, require no modification of the ski, do no damage to the ski, and be inexpensive.

The Edgie Wedgie product has a flexible curved rubber tube with two screw clamps. The first screw clamp is at one end of the tube and the second screw clamp is at the other end of the tube. The screw clamps are parallel with the curved tube to form a curved line.

The screw clamps are screwed to the ski tips. The Edgie Wedgie forces the ski tips and skis into a wedge shape.

A similar device to the Edgie Wedgie is found in U.S. Pat. No. 3,703,299 for a snowplow skiing position device. The device has a flexible strap between two clamps. The clamps can be C-clamps or a rubber notched clamp, which attach to the outside edge of the ski tips. The strap has a grommet in the middle so an instructor can insert his or her ski pole in the grommet to slow down the skier.

The use of screw clamps presents several major problems with ski tip devices.

A screw clamp has a single point of contact with the ski tip. The skis can shift laterally when held by a screw clamp because there is only that one point of contact. The clamps tend to work loose and fall off the ski tips due to vibration, cold weather and the single point of contact.

Screw clamps tend to gouge and damage the ski itself at the ski tip.

The protruding screw of the screw clamp sticks up above the ski tip and is dangerous if the skier falls forward.

The screw on a screw clamp is difficult to turn if the skier is wearing gloves or mittens. There is always a 50/50 chance with a screw clamp that the skier will tune the screw the wrong way, tightening the screw when the skier wants to loosen and release the screw, or loosening and releasing the screw when the skier wants to tighten the screw.

Sleeves and screw clamps are used in U.S. Pending Patent Application 20090039635 for a ski tip connector. This connector has a latex tube with two closed sleeves. A sleeve is at each end of the tube. The closed sleeve has a thumbscrew. A sleeve is slipped over the ski tip and held in place by tightening the thumbscrew. The latex tubing keeps the skis in a wedge shape. The tubing can have a hook attached to one sleeve so the ski tip connector tubing can be unhooked with the sleeves still fastened to the ski tips.

U.S. Pat. No. 4,828,288 has a ski tip linking device. The device has two closed attachment devices (or sleeves) which each fit snugly over a ski tip. A screw clamp holds the sleeves to the ski tip.

The patent has a different connector though. Each attachment device has a rigid arm extending forward at a 45 degree angle. The two arms are attached at a ball and cup joint.

Past devices require that various connectors be clamped, screwed or glued to the skis. Some require permanent attachment to the skis.

U.S. Pat. No. 3,357,714 has plates screwed to the upper surfaces of two water skis. Each plate has a ball and socket joint extending upward. The ball joints are connected by a rigid spring between the skis. The spring and ball and socket joints keep the skis together to form a wedge or in parallel. The plates screwed into the skis are permanent or very difficult to remove.

U.S. Pat. No. 3,992,022 has hook and eyelet rods to keep the skis in a snowplow position. A metal clamp fits around a ski and is held in position by a screw. The first screw metal clamp on one ski has a lateral metal rod with a hook. The second screw metal clamp on the other ski has a lateral metal hook with an eyelet. The hook fits within the eyelet to hold the skis locked into a snowplow position.

U.S. Pat. No. 4,936,603 has a rigid bar between two flexible members for linking ski tips. Each ski tip has a flexible member extending up from the ski with the bar held between the two ski tip members. The members are screwed into the ski. The rigid bar and flexible members allow the skis to remain in snowplow position while the skis are used in downhill or in turns.

U.S. Pat. No. 5,531,480 has a screw clamp holding a ball and socket joint to each ski tip. A connecting rod extends between the two ball and socket joints on the ski tips. The ski tips can move independently of each other but maintain a fixed distance apart. The ball and socket joint allows the skis to move up-and-down and back-and-forth relative to each other within the fixed distance. The skis can be parallel or form a wedge.

U.S. Pat. No. 3,264,663 uses a hollow metal strut and a pair of suction cups to hold water skis parallel. One suction cup is attached to each water ski on the main ski body. The suction cups need a flat surface to adhere. The suction cups have upstanding bosses, which hold the metal strut between the suction cups and skis.

It is an object of the present invention to provide a ski tip connecting device that does not have a difficult-to-use, ski damaging, and dangerous screw clamp.

It is another object of the present invention to provide a ski tip connecting device that holds the ski tips to easily form a snowplow for the skier; that is easy to use; that is readily attachable and quickly detachable, even when wearing mittens or gloves; and is flexible and resilient to minimize the shocks of skiing through snow.

SUMMARY OF THE INVENTION

According to the present invention, a ski tip connecting device has a flexible connector connecting a first lever clamp to a second lever clamp. The first lever clamp holds the ski tip of a first ski. The second lever clamp holds the ski tip of a second ski. The flexible connector maintains a short distance between the ski tips allowing the ski tails to separate to a wider distance with the skis forming a snowplow position.

Each lever clamp has a moveable flat lever with a pressure plate at one end, a stationary c-shaped jaw with an abutment plate on an inside surface and a pivot shaft extending widthwise through the lever and the jaw to pivot the lever down towards the jaw so the pressure plate and abutment plate can securely hold a ski tip between the plates.

The connector is a hollow rubber tube connected to a first metal pin on the first lever clamp and a second metal pin of the second lever clamp. Each pin fits securely within the rubber tube and extends a distance into the tube from opposite directions. The pins give a certain rigidity to the ends of the flexible tube and the connector.

A tether can be attached to the lever clamps to allow a ski instructor skiing behind the skier to control the speed and direction of the skier.

Other aspects of the invention will become apparent from the following more detailed description, taken in conjunction with the accompanying drawings.

BRIEF DESCRIPTION OF THE DRAWINGS

The preferred embodiments of this invention will be described in detail, with reference to the following figures wherein.

DETAILED DESCRIPTION OF PREFERRED EMBODIMENTS

Figure 1:
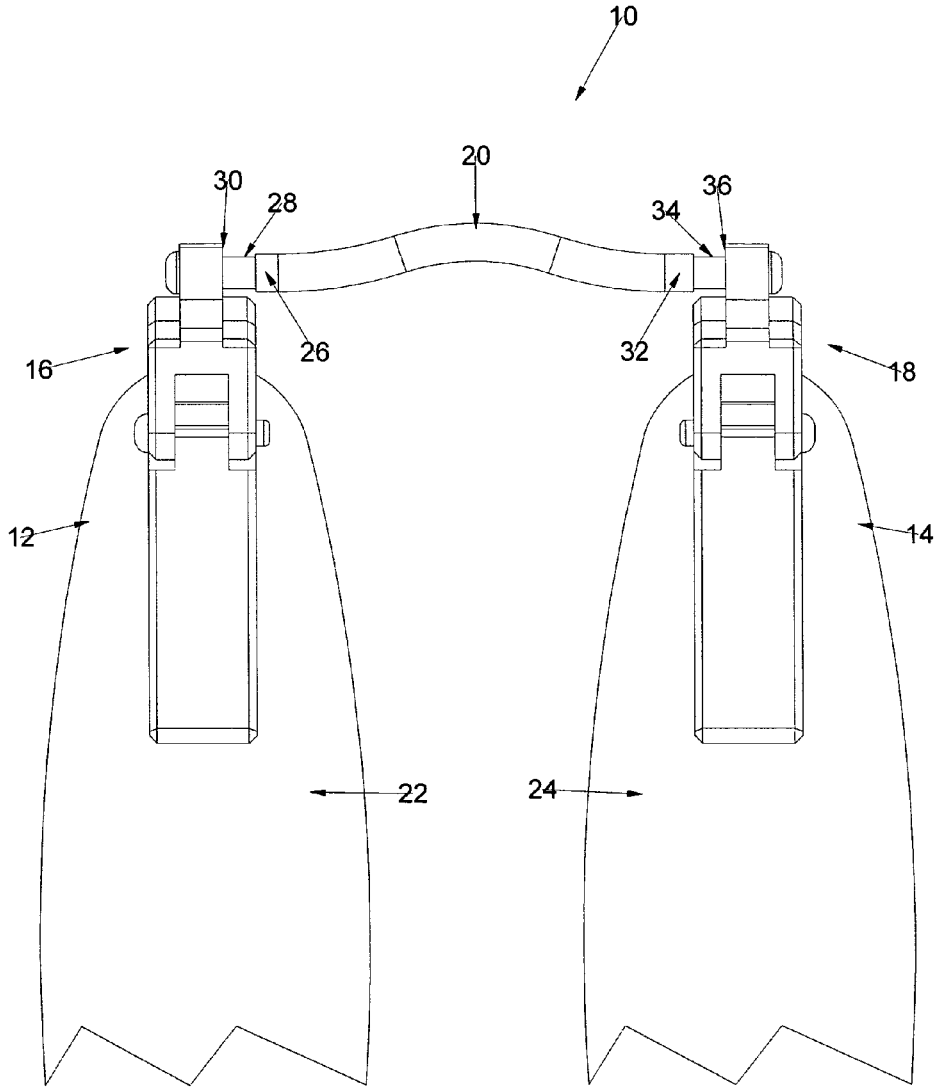
FIG. 1 is a top view of the flexible ski tip connecting device of the present invention attached to a pair of ski tips.

Reference is now made to FIG. 1 illustrating a flexible ski tip connecting device 10 attached to a pair of ski tips 12 and 14. The ski tip connecting device 10 has a first lever clamp 16, a second lever clamp 18 and a flexible connector 20 connecting the first lever clamp to the second lever clamp.

The closed first lever clamp 16 is securely holding the ski tip 12 of the first ski 22. The closed second lever clamp 18 is securely holding the ski tip 14 of the second ski 24.

The flexible connector 20, which is a strong flexible hollow tube in this embodiment, is attached at a first end 26 to a first pin 28 protruding from the inside side 30 of the first lever clamp 16. For the purposes of this invention, the inside is towards the skier and the outside is away from the skier. The first or left clamp is on the ski tip of the left ski of the skier so the first pin protrudes from the right side of the first or left lever clamp.

The flexible connector 20 is attached at a second end 32 to a second pin 34 protruding from the inside side 36 of the second lever clamp 18. The second or right clamp is on the ski tip of the right ski of the skier so the second pin protrudes from the left side of the second or right lever clamp. The inside side 30 of the first lever clamp 16 is opposite and facing the inside side 36 of the second lever clamp 18.

Each pin fits securely within the hollow tube and extends a distance into the tube from opposite directions. The pins give a certain rigidity to the ends of the flexible tube and the connector. The pins are typically stainless steel or other metals.

The flexible connector 20 is approximately six inches from first lever clamp 16 to second lever clamp 28 and maintains a rough distance between the attached ski tips 12 and 14. The flexibility of the connector allows the ski tips to be closer than six inches while remaining connected.

Typically, the center of the hollow tube between the two lever clamp pins is hollow giving the tube and the connector flexibility. The tube is typically rubber, plastic or other flexible materials.

Alternately, the center of the tube between the two steel pins can be solid rubber to provide a more rigid tube and connector. The flexible connector can be bungee cord or a metal cable.

Figure 2:
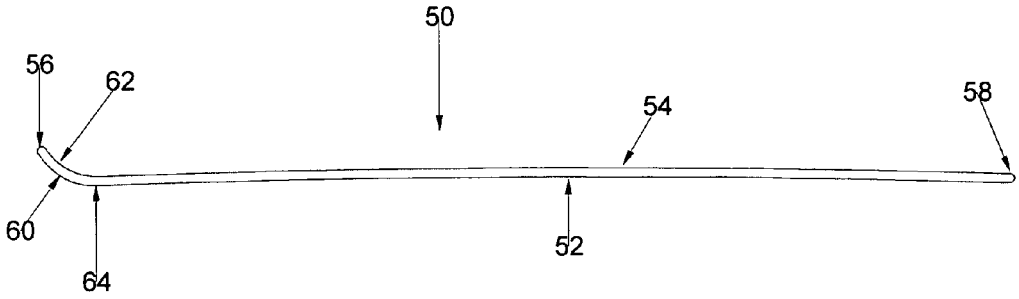
FIG. 2 is a side view of a ski.

As can be seen in FIG. 2, a ski 50 (not drawn to scale) has a generally flat bottom surface 52 and a generally flat top surface 54. An upturned ski tip 56 is at the front of the ski 50. The back of the ski is the tail 58. The ski tip 56 has a generally flat bottom surface 60 and a generally flat top surface 62. The ski curves upward from a flat surface to the upraised ski tip at the point of inflection 64. Skis can be manufactured from wood, metals, plastics, polymers, fiberglass, carbon fibers, epoxies, or combinations of these materials, although the invention is equally applicable to skis made of any material.

Figure 3:
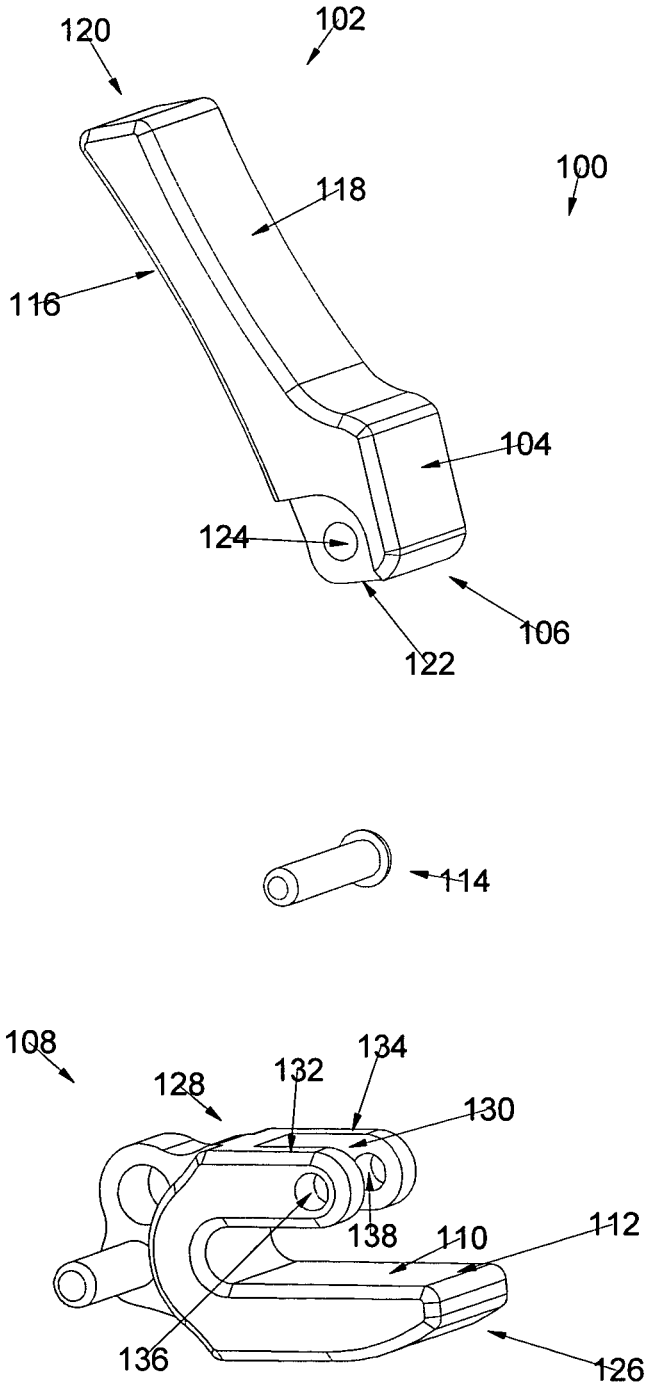
FIG. 3 is an exploded view of the lever clamp of the present invention.

A lever clamp 100 (identical to first lever clamp 16 and second lever clamp 18 of FIG. 1) in the exploded view of FIG. 3 of the present invention consists of a moveable flat lever 102 with a pressure plate 104 at one end 106, a stationary c-shaped jaw 108 with an abutment plate 110 on an inside surface 112 and a pivot shaft 114 extending widthwise through the lever 102 and the jaw 108 to pivot the lever down towards the jaw so the pressure plate 104 and abutment plate 110 can securely hold a ski tip between the plates.

The flat lever 102 and the c-shaped jaw 108 can be formed of rubber, plastic, a synthetic polymer, neoprene, Delran, polypropylene, polystyrene, polyethylene, polyvinyl chloride, or nylon. The lever clamp 100 should be coldproof and waterproof for a snow ski.

The flat lever 102 has two flat opposing surfaces 116, 118 at a first end 120 so that the skier can easily grasp and move the lever while in a cold and/or wet environment while wearing gloves or mittens. The second end 106 of the flat lever has a pressure plate 104 adjacent to a single centered prong 122. The center prong 122 has a pivot hole 124 extending across the width of the prong.

Figure 4:
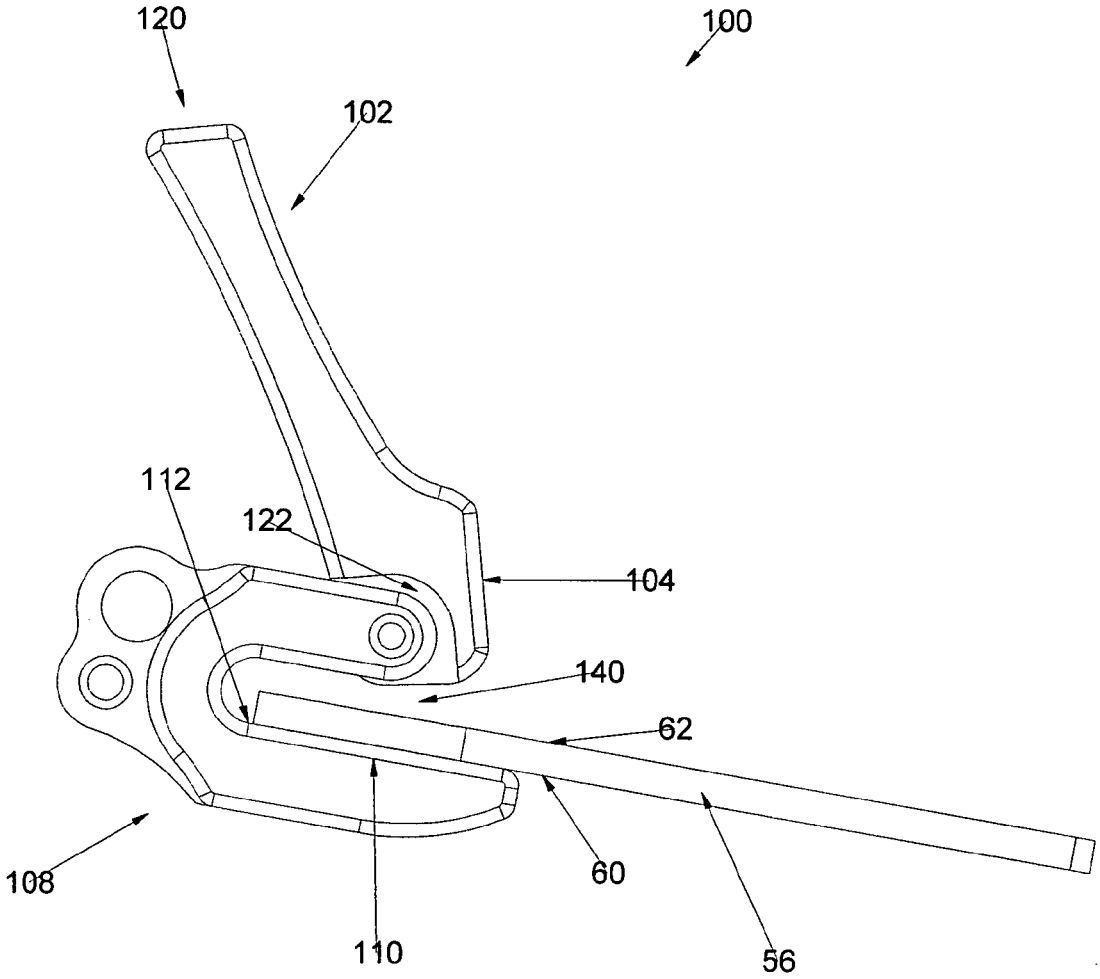
FIG. 4 is a side view of an open lever clamp and a ski tip of the flexible ski tip connecting device of the present invention.
Figure 5:
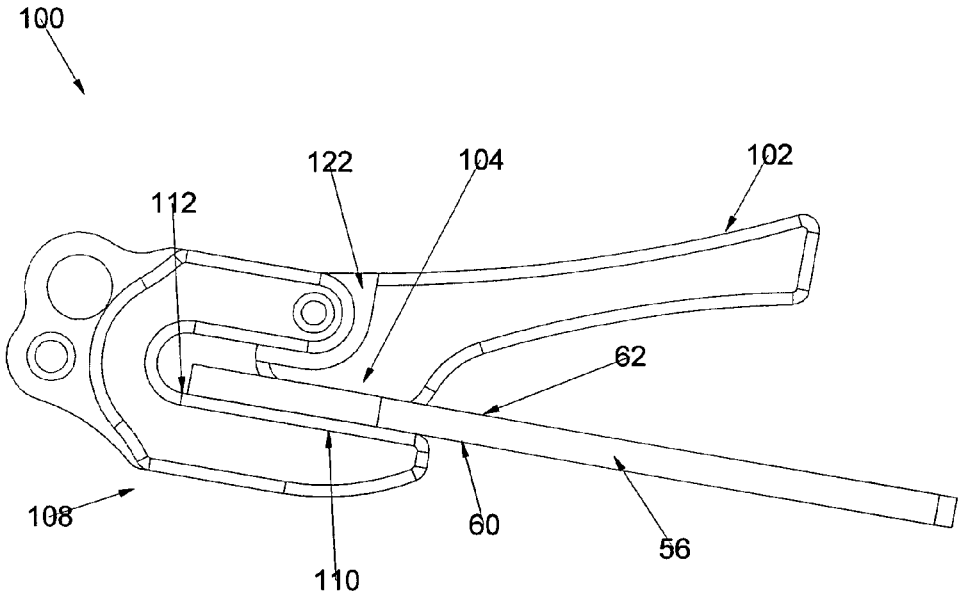
FIG. 5 is a side view of a closed lever clamp holding a ski tip of the flexible ski tip connecting device of the present invention.

As show in FIG. 4, when the lever 102 is open, the pressure plate 104 is above the single prong 122. As shown in FIG. 5, when the lever 102 is closed, the pressure plate 104 is below the single prong 122.

Returning to FIG. 3, the stationary c-shaped jaw 108 has a first lower end 126 with an abutment plate 110 on the upper surface 112 or inside surface. The second upper end 128 of the c-shaped jaw has a double or split prong with a space 130 between the two prongs 132, 134. The first prong 132 has a pivot hole 136 extending across the width of the first prong. The second prong 134 has a pivot hole 138 extending across the width of the second prong.

The single centered prong 122 of the flat lever 102 is inserted between the two spaced apart prongs 132, 134 of the c-shaped jaw 108. The pivot holes 124, 136 and 138 of the three prongs are aligned. The pivot shaft 114 is inserted and securely mounted in the three aligned holes. The pivot shaft may be a bolt, a rivet, a screw, or similar elements and is typically made of a metal. The pins of the flexible connector can be an extension along the inside surface of the pivot shaft.

Turning to FIGS. 4 and 5, the moveable lever 102 can pivot back and forth in one direction relative to the stationary jaw 108. The lever 102 can pivot down to clamp the ski tip 56 between the lever 102 and the jaw 108. The lever 102 can pivot up to release the ski tip 56 from the lever 102 and the jaw 108.

When the lever clamp 100 is open, the first end 120 of the lever is up and away from the jaw. The pressure plate 104 on the lever is above the single center prong 122 and the c-shaped jaw 108.

A ski tip 40 is inserted into the c-shaped jaw 108 so that the bottom surface 60 of the ski tip 56 is adjacent to the abutment plate 110 on the inside surface 112 of the c-shaped jaw. The ski tip can be touching the abutment plate or simply adjacent to the abutment plate.

The lever 102 is pivoted by hand towards the open mouth 140 of the jaw. The pressure plate 104 of the lever contacts the top surface 62 of the ski tip 56 forcing the bottom surface 60 of the ski tip against the abutment plate 110 of the jaw. The pressure plate and the abutment plate hold the ski tip in position. The ski tip is now securely held by the lever clamp.

The lever can have a cam edge in front and adjacent to the pressure plate to lock with the abutment plate into position. The cam action prevents the lever from slipping back into the open position. The slightly flexible clamp will flex and the angle the clamp forms in the down position will form the pressure to hold into the closed position.

To release the ski tip, the lever is pivoted by hand away from open mouth of the jaw. The pressure plate of the lever releases contact with the ski tip. The abutment plate can be in contact with the ski tip or the ski tip can be adjacent to the abutment plate.

The pressure plate and the abutment plate are now not holding the ski tip. The ski tip can be moved into another position between the pressure plate and the abutment plate or removed from the clamp lever.

The pressure plate 104 and/or the abutment plate 110 can have a gripping pattern, such as parallel lines or a crosshatch pattern, on their contact surfaces. Similarly, the contact surface of pressure plate and/or the abutment plate can be formed of a different gripping material than the rest of the pressure plate and/or the abutment plate.

This invention uses a lever clamp, rather than the screw clamp of the prior art. A lever clamp can be flipped down to clamp on the ski tip and flipped up to release the ski tip. This simple motion can be done with the skier wearing gloves or mittens and with minimal strength. By contrast, the screw on a screw clamp is difficult to turn if the skier is wearing gloves or mittens and requires brute strength.

A screw clamp has a single point of contact with the ski tip while the lever clamp of the invention has a significantly larger two-dimensional gripping surface contact with the ski tip.

The screw clamp with its single point of contact can damage the ski tip. The protruding screw of is dangerous if the skier falls. A lever clamp has a flat lever which, when closed holding the ski tip, is parallel to the ski tip. It presents less danger to a falling skier.

The lever clamp is also easy for an instructor to use to release the ski tips of the skier.

The ski connecting device with the two lever clamps can easily tighten the ski tips into position and can withstand the force of skiing.

The ski connecting device allows the skis to be easily connected or disconnected for lift rides, when walking across the snow or flat terrain, or to evaluate the progress of the skier during a lesson.

Figure 6:
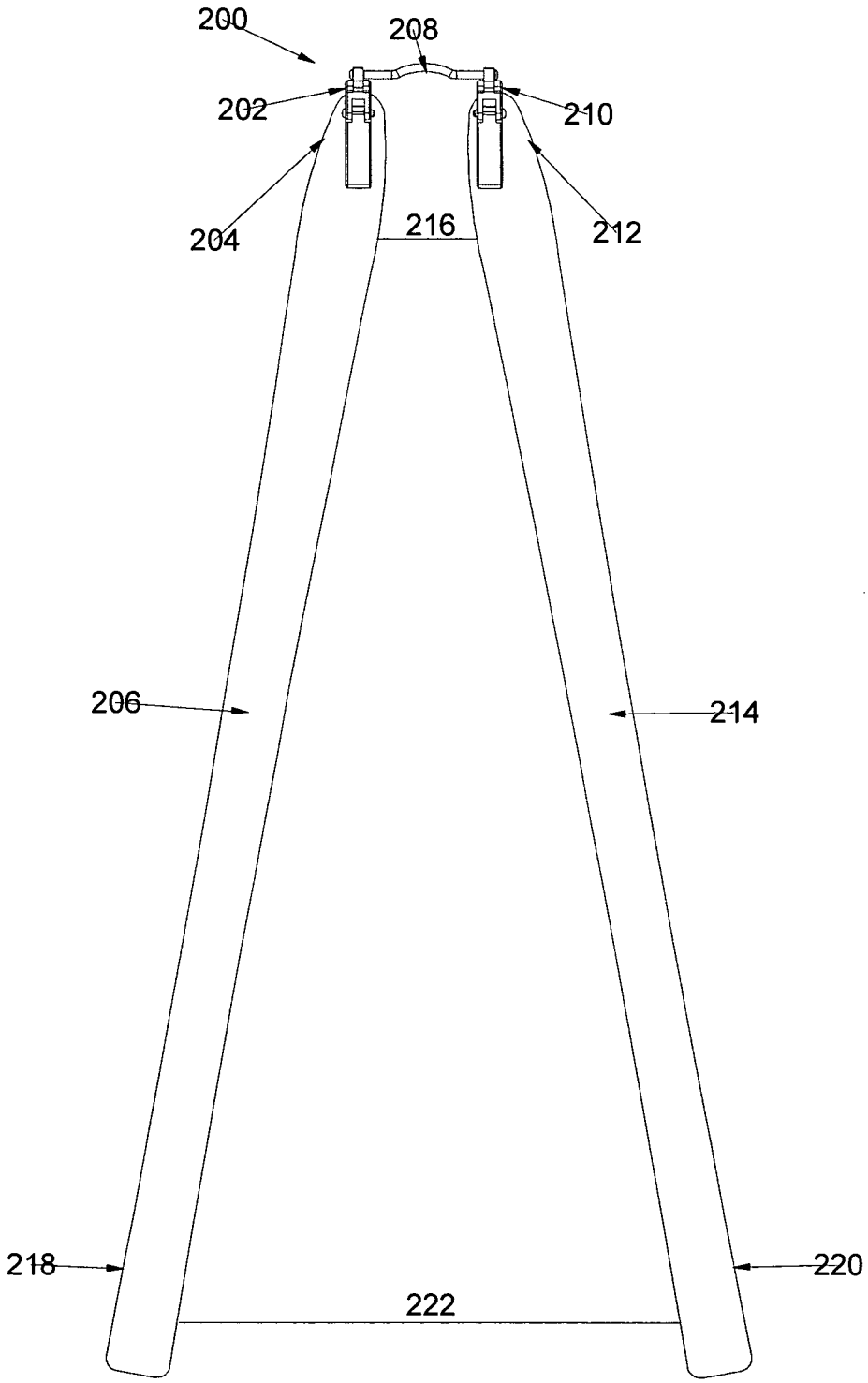
FIG. 6 is a top view of the flexible ski tip connecting device of FIG. 1 with the pair of skis in snowplow position.

The ski tip connecting device 200 in FIG. 6 holds the skis in a snowplow position. A first lever clamp 202 securely holding a first ski tip 204 of a first ski 206 is connected by a flexible connector 208 to a second lever clamp 210 holding a second ski tip 212 of a second ski 214.

The flexible connector 208 maintains a short distance 216 between the ski tips 204, 212. The flexibility of the connector allows the ski tips to move relative to each other and closer as the skis traverse the bumps and hills of a ski slope.

The first tail 218 of the first ski 206 is separated from the second tail 220 of the second ski 214. The distance 222 between tails 218, 220 is wider than the distance 216 between ski tips 204, 212 held by the connector 208 so the skis form the traditional V shape of a snowplow.

The flexible connector allows the skier to create, hold and adjust the shape of the snowplow position. The flexible connector allows the angle of the snowplow to vary, allows the ski tips to vary in elevation relative to each other as well as distance apart so the skier can control the speed and direction of the snowplow while skiing in the snow down the ski slope.

The ski tip connecting device prevents the skier's ski tips from spreading apart and the resulting action of the skis spreading apart. Younger skiers, older skiers and skiers without well developed leg strength and control can learn to coordinate their legs to turn the ski tips in towards each other to form a snowplow, eventually without the ski tip connecting device.

Figure 7:
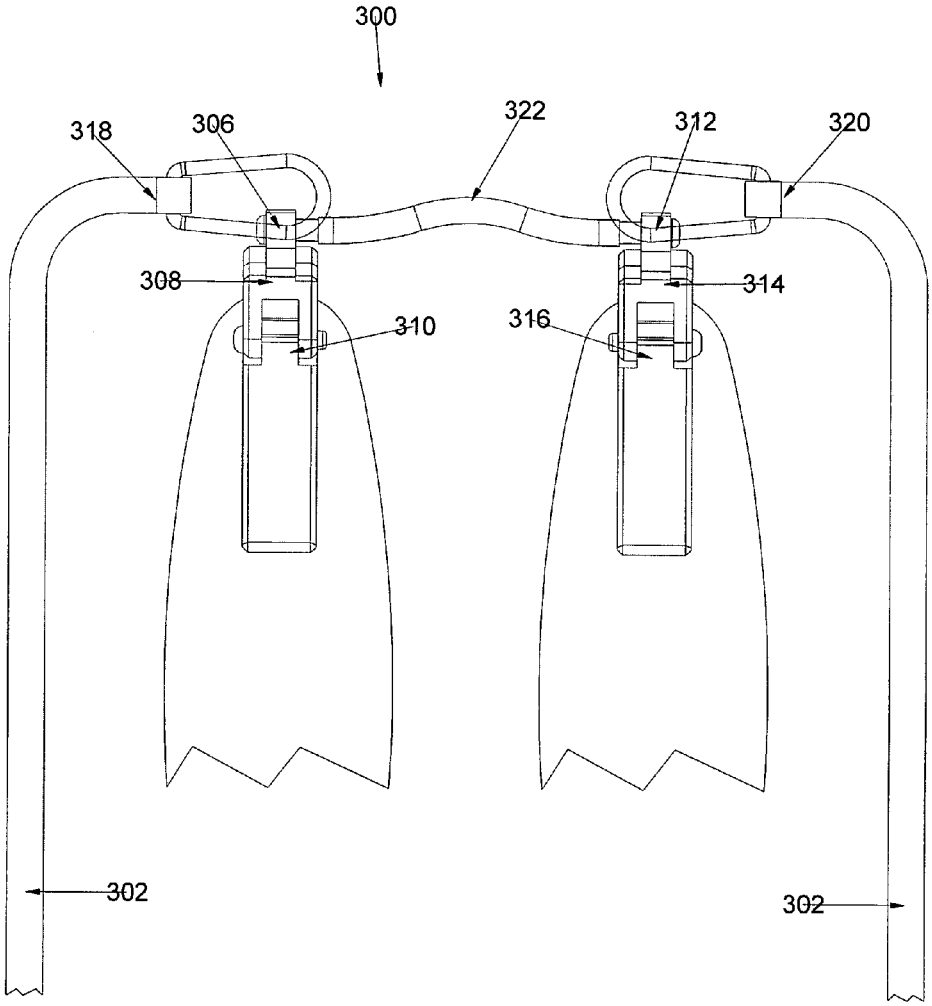
FIG. 7 is a top view of a tether attached to the flexible ski tip connecting device of the present invention.
Figure 8:
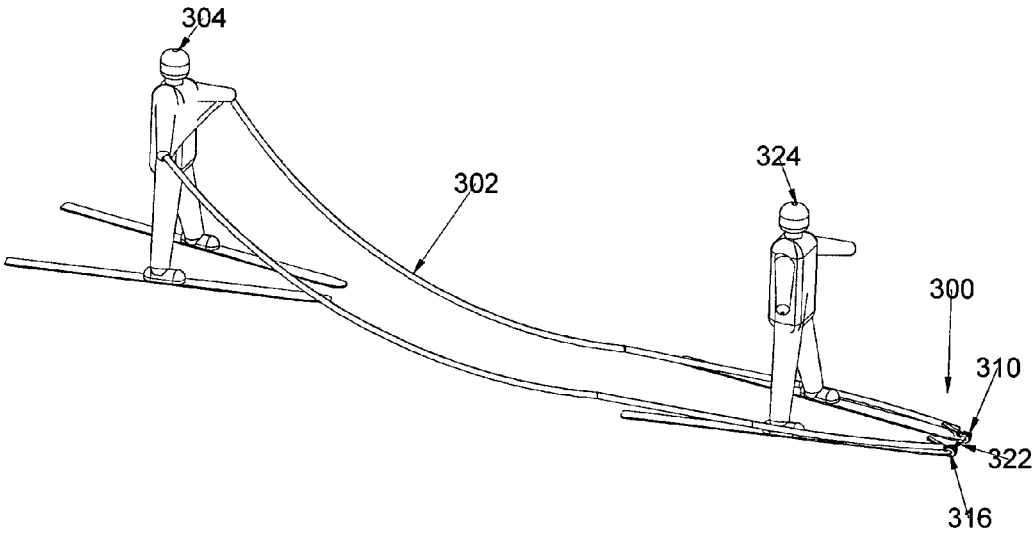
FIG. 8 is a perspective view of the flexible ski tip connecting device of FIG. 7 being pulled by the attached tether by a ski instructor.

The ski tip connecting device 300 has a tether 302 for a ski instructor 304 in FIGS. 7 and 8.

A first hole 306 extends across the width of the first jaw 308 of the first lever clamp 310. A second hole 312 extends across the width of the second jaw 314 of the second lever clamp 316.

A tether 302 is threaded through the first hole 306 and the second hole 312. The first end 318 of the tether is secured to the first jaw by tying off the outside end, or other means such as the tether attached to a D-ring held within the hole. The second end 320 of the tether is secured to the second jaw by tying off the outside end or other means such as the tether attached to a D-ring held within the hole.

The tether 302 extends from the first lever clamp 310 to the second lever clamp 316. The tether is approximately 10 feet long and significantly longer than the ski connector 322, which also extends from the first lever clamp 310 to the second lever clamp 316.

The tether 318 is held at its approximate mid-point by a ski instructor 304 skiing behind the skier 324. The tether extends from the ski tip connecting device in the front, around the skier to the ski instructor behind. The tether allows the instructor to control the skier's speed and direction while also giving instructions to the skier.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A ski tip connecting device comprising a first ski having a first end and a second end, with a first ski tip at said first end and a first tail at said second end a second ski having a first end and a second end, with a second ski tip at said first end and a second tail at said second end;

a first lever clamp for holding and releasing said first ski tip of said first ski; said first lever clamp having a moveable flat lever with a pressure plate, a stationary c-shaped jaw with an abutment plate on an inside surface of said stationary c-shaped jaw; and a pivot shaft extending through said moveable flat lever and said stationary c-shaped jaw to pivot said moveable flat lever down towards said stationary c-shaped jaw to hold said first ski tip between said pressure plate and said abutment plate;

a second lever clamp for holding and releasing said second ski tip of said second ski; said second lever clamp having a moveable flat lever with a pressure plate, a stationary c-shaped jaw with an abutment plate on an inside surface of said stationary c-shaped jaw; and a pivot shaft extending through said moveable flat lever and said stationary c-shaped jaw to pivot said moveable flat lever down towards said stationary c-shaped jaw to hold said ski tip between said pressure plate and said abutment plate; and a flexible connector attached at a first end to said first lever clamp and attached at a second end to said second lever clamp; wherein said flexible connector maintains an approximate distance between said first ski tip of said first ski and said second ski tip of said second ski while said first tail of said first ski and said second tail of said second ski have a larger distance apart thus forming a snowplow position for the first ski and the second ski.

2. A ski tip connecting device comprising a first ski having a first end and a second end, with a first ski tip at said first end and a first tail at said second end;

a second ski having a first end and a second end, with a second ski tip at said first end and a second tail at said second end;

a first lever clamp for holding and releasing said first ski tip of said first ski; said first ski clamp has a first pin extending from a surface of said first ski clamp;

a second lever clamp for holding and releasing said second ski tip of said second ski; said second ski clamp has a second pin extending from a surface of said second ski clamp; and a flexible connector attached at a first end to said first lever clamp and attached at a second end to said second lever clamp; wherein said flexible connector maintains an approximate distance between said first ski tip of said first ski and said second ski tip of said second ski while said first tail of said first ski and said second tail of said second ski have a larger distance apart thus forming a snowplow position for the first ski and the second ski; and said flexible connector being a hollow tube having a first end and a second end; wherein said first pin of said first lever clamp fits within said first end of said hollow tube and said first pin of said second lever clamp fits within said second end of said hollow tube.

* * * * *